US007180453B2

(12) United States Patent
Nakagawa et al.

(10) Patent No.: US 7,180,453 B2
(45) **Date of Patent: *Feb. 20, 2007**

(54) ANTENNA FOR PORTABLE CELLULAR TELEPHONE

(75) Inventors: Yoshinobu Nakagawa, Osaka (JP); Koji Sako, Okayama (JP); Masaaki Yamabayashi, Tsuyama (JP); Kazumine Koshi, Tsuyama (JP); Naoyuki Takagi, Joyo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/063,520

(22) Filed: Feb. 23, 2005

(65) Prior Publication Data

US 2005/0225488 A1 Oct. 13, 2005

(30) Foreign Application Priority Data

Apr. 9, 2004 (JP) ..... 2004-115284
May 27, 2004 (JP) ..... 2004-157396

(51) Int. Cl.
*H01Q 1/24* (2006.01)

(52) U.S. Cl. ..... 343/702

(58) Field of Classification Search ..... 343/702, 343/745, 749, 725
See application file for complete search history.

(56) References Cited

U.S. PATENT DOCUMENTS 6,154,177 A * 11/2000 Saito et al. ..... 343/702
6,222,499 B1 * 4/2001 Goetz et al. ..... 343/860
6,873,299 B2 * 3/2005 Dakeya et al. ..... 343/745
6,914,570 B2 * 7/2005 Asrani et al. ..... 343/702
2004/0253972 A1 * 12/2004 Iwai et al. ..... 455/550.1

FOREIGN PATENT DOCUMENTS

JP 2003-101335 4/2003

* cited by examiner

*Primary Examiner*—Trinh Dinh
*Assistant Examiner*—Huedung Mancuso
(74) *Attorney, Agent, or Firm*—RatnerPrestia

(57) ABSTRACT

An antenna for portable cellular telephone can adjust each of multiple antenna elements efficiently and independently to a predetermined resonance frequency. A first antenna element and second antenna element are mounted on and anchored to one common base. Terminals for feeding power to the first antenna element and the second antenna element are provided respectively. The terminals are coupled to matching circuits. This structure facilitates separate and efficient adjustment of resonance frequency of the first antenna element and the second antenna element.

5 Claims, 9 Drawing Sheets

ANTENNA FOR PORTABLE CELLULAR TELEPHONE

FIELD OF THE INVENTION

The present invention relates to antennas for portable transceiver, typically mobile phones.

BACKGROUND ART

Portable transceiver are becoming ever smaller and lighter. Mobile phones, which are typical wireless terminals subject to this trend, offer a widening range of services for data communications, such as text and video transmissions, in addition to voice communications. Accordingly, the performance of the antenna, which is used for transmitting and receiving radio waves, and inputting and outputting signals, is one factor affecting the performance of mobile phones.

In the field of mobile phones, a single antenna that can receive and transmit signals via multiple radio frequencies at high sensitivity is highly demanded.

A conventional antenna for portable cellular telephone installed in a mobile phone is described next with reference to FIG. 9.

FIG. 9 is a schematic view of the mobile phone in which the conventional antenna for portable cellular telephone is installed. As shown in FIG. 9, portable transceiver antenna 3 is disposed in parallel to ground plane 8. This portable transceiver antenna 3 includes first antenna element 1 that resonates at a first radio frequency and second antenna element 2 that resonates at a second radio frequency. In wireless terminal 9, portable transceiver antenna 3 is coupled to feeding point 4 provided on ground plane 8, and then to radio circuit 7 via matching circuit 5 and transmission line 6.

Accordingly, conventional portable transceiver antenna 3 is configured to receive power from one common feeding point 4 for both first antenna element 1 and second antenna element 2. In the following description, first antenna element 1 resonates at GSM (Global System for Mobile communication: 880~920 MHz) frequencies and second antenna element 2 resonates at DCS (Digital Cellular System: 1,100~1,880 MHz) frequencies, frequencies higher than those for first antenna element 1.

For receiving GSM radio frequencies, in the above structure, the current induced by the radio waves received by first antenna element 1 is transmitted from feeding point 4 to radio circuit 7 via matching circuit 5 and transmission line 6 so as to receive a predetermined signal.

For transmitting GSM radio frequencies, a predetermined signal generated at radio circuit 7 is sent from transmission line 6 to first antenna element 1 via matching circuit 5 and feeding point 4. This signal is then induced in first antenna element 1 and emitted as radio waves.

Also for DCS, radio waves are conventionally transmitted and received at second antenna element 2 via single feeding point 4 in the same way as for GSM.

In the conventional antenna for portable cellular telephone, however, resonance frequencies in two significantly different ranges cannot readily be independently and efficiently adjusted because the conventional antenna is configured to feed power to first antenna element 1 and second antenna element 2 from one feeding point 4. In addition, matching circuit 5 for gaining two different resonance frequencies of GSM and DCS is also shared.

One of the prior arts related to the present invention is disclosed in the Japanese Patent Laid-open Application No. 2003-101335.

SUMMARY OF THE INVENTION

An antenna for a portable cellular telephone allows efficient and independent adjustment of multiple antenna elements to a predetermined resonance frequency and a broader bandwidth.

The antenna for a portable cellular telephone includes a first antenna element with a first feeder for coupling to a first matching circuit and a second antenna element with a second feeder for coupling to a second matching circuit. These antenna elements are anchored to a common single resin base.

Since each antenna element has a respective feeder in the antenna for portable cellular telephone of the present invention, each antenna element can be coupled to a different matching circuit. This allows each antenna element to be efficiently and independently adjusted, such as by tuning, to a predetermined radio frequency.

In addition, the antenna for a portable cellular telephone involves capacitive coupling between the first antenna element and second antenna element. This capacitive coupling improves the band sensitivity at high radio frequencies to be received and transmitted. Furthermore, the structure which anchors two independent antenna elements on a common base, allows effective utilization of the capacitive coupling generated between the two antenna elements.

More specifically, the resonance frequency of one antenna element for low radio frequencies is also generated at high radio frequencies. This high resonance frequency is set within or adjacent to an applicable radio high frequency band for the other antenna element. The resonance point of the other antenna element is set in the applicable radio high frequency band or shifted to a slightly higher radio frequency than this band. In this way, the power is fed to both antenna elements when the other antenna element is in operation, establishing capacitive coupling. This structure couples high radio frequencies of one antenna element and applicable radio frequencies of the other antenna element so as to achieve higher sensitivity for the antenna characteristic at high radio frequencies and a broader bandwidth.

Still more, the antenna for a portable cellular telephone employs the first feeder and second feeder which both have a terminal shape suitable for surface mounting. Accordingly, the feeders can be mounted on a wiring board of the portable transceiver to permit automated surface mounting, the same as other components. This facilitates mounting of the feeders with a high degree of precision.

Still more, the antenna for a portable cellular telephone includes the base, to which the first antenna element and second antenna element are anchored, of approximately rectangular parallelepiped. A feeding terminal or a dummy terminal for reinforcement disposed on the longer side face of the base is formed into an L-shape. This terminal protrudes from the side of the base and is mounted parallel to a longer side of the base.

The base is made of resin and is formed in an approximately rectangular parallelepiped. The base is expected to stretch or shrink along the longer hand side when each antenna element is mounted. However, the above structure reduces the effect of stretching and shrinking on a soldered portion, and maintains a stable mounting condition.

Furthermore, the antenna for a portable cellular telephone has a first antenna element or second antenna element that is shorter than the length corresponding to their applicable radio frequencies. A coil component equivalent to this shortage is supplemented by a coil element installed in the portable transceiver.

This structure allows shortening of the length of the antenna element, further downsizing and slimming the base where the antenna element is disposed. Consequently, the antenna itself can be made further smaller and thinner.

DETAILED DESCRIPTION OF THE INVENTION

An exemplary embodiment of the present invention is described below with reference to FIGS. 1 to 8. In the following description, phrases for indicating relative positional relationship such as "left side face," "top face," and "underside" are used. These phrases are used, as a matter of practical convenience, to indicate relational positions of members when each drawing is seen from the front, and thus they are not absolute positions of the members.

PREFERRED EMBODIMENT

Figure 1:
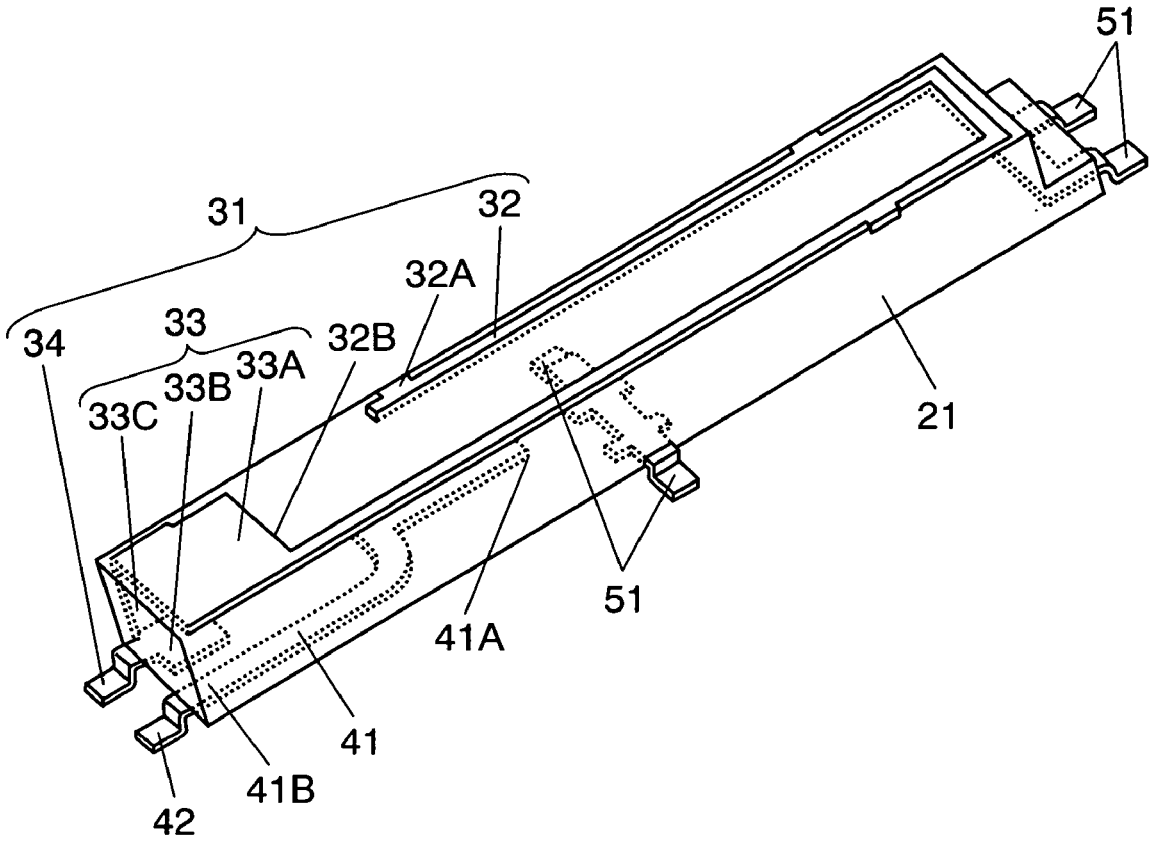
FIG. 1 is a perspective view of the appearance of an antenna for portable cellular telephone in accordance with a an exemplary of the present invention.
Figure 2:
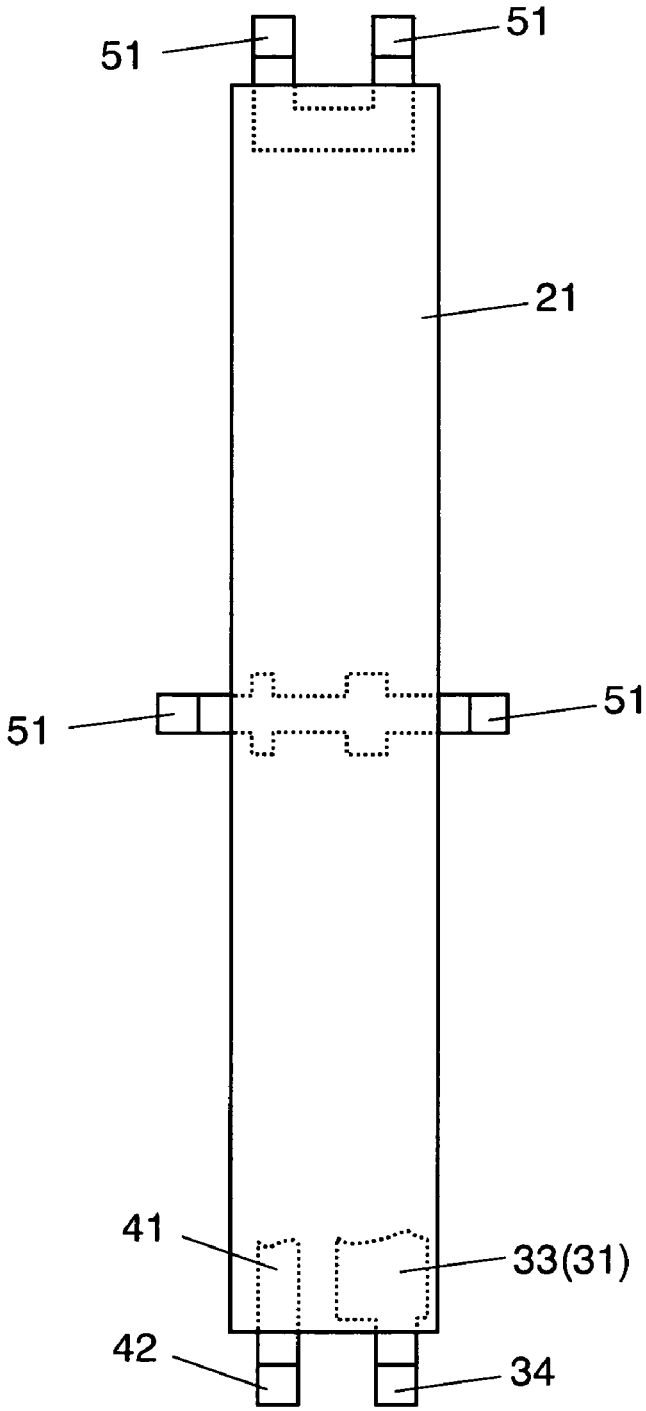
FIG. 2 is a bottom view of the same antenna.

FIG. 1 is a perspective view of the appearance of an antenna for portable cellular telephone in accordance with an exemplary embodiment of the present invention, and FIG. 2 is a bottom view of the antenna.

In FIGS. 1 and 2, base 21, of a size that can be housed inside the portable transceiver, is made of heat-resistive resin suitable for surface mounting such as polyphthalamide (PPA). The dielectric constant of base 21 is approximately 4. The use of a material with a higher dielectric constant allows a lower resonance frequency or a smaller antenna. On the other hand, a higher dielectric constant causes a larger dielectric loss, resulting in degradation of antenna radiation characteristics.

Base 21 is an approximately rectangular parallelepiped, and first antenna element 31 and second antenna element 41 made of a thin metal sheet are anchored to base 21 by insert molding.

As shown in FIG. 1, first antenna element 31 includes strip 32 anchored to the top face of base 21; U-shaped section 33, a part of which is open; and terminal 34 protruding from the left side face of base 21. These sections and members are integrally made, typically by bending after punching a predetermined shape from a thin metal sheet.

Strip 32 is disposed along the periphery of the top face of base 21 in a U shape with approximately uniform width. One end 32A of strip 32 is left open, and the other end 32B is integrated with top face 33A of U-shaped section 33 anchored to the left end of base 21. Strip 32 and top face 33A are embedded in base 21 in the thickness direction so that the surface of strip 32 and top face 33A is exposed on the top face of base 21.

U-shaped section 33 includes underside 33B opposing top face 33A and connection 33C joining top face 33A and underside 33B. The entire face of connection 33C is embedded on the rear face of base 21, and the entire face of underside 33B is embedded and anchored to the underside of base 21.

Terminal 34 protrudes from underside 33B of U-shaped section 33, and is led out from the far bottom end of the left side face of base 21. Terminal 34 is formed into a shape suitable for surface mounting. In other words, the underside of terminal 34 (33B) and the underside of base 21 are approximately level. Terminal 34 is the first feeding point of first antenna element 31.

Second antenna element 41 is formed into a strip, and its entire face is embedded in and anchored to the underside of base 21. The length of second antenna element 41 is approximately half of a longer side of base 21 and shorter than first antenna element 31. One end 41A of second antenna element 41 is left open. The other end 41B is coupled to terminal 42 which protrudes outward from the near bottom end of the left side face of base 21. The underside of terminal 42 and the underside of base 21 are approximately level to allow surface mounting. Terminals 34 and 42 are disposed in parallel on the left side face of base 21, when FIG. 1 is seen from the front, independent of each other. Terminal 42 is a second feeding point of second antenna element 41.

Dummy terminal 51 having a shape suitable for surface mounting is provided at approximately the center of base 21. The shape suitable for surface mounting, as already described, is that dummy terminal 51 be disposed in such a way that the underside of terminal 51 and the underside of base 21 are approximately level.

Dummy terminal 51 is provided as a fixing reinforcement member for attaching base 21 onto a wiring board. A portion of dummy terminal 51 embedded in base 21 is roughened such that the stress applied to the shorter side of base 21 can be reduced and bonding with base 21 can be strengthened.

In the antenna in the exemplary embodiment of the present invention, first antenna element 31 and second antenna element 41 are anchored to one common base 21, and separate terminals 34 and 42 are individually led out from these antenna elements. Terminals 34, 42 and 51 have a shape suitable for surface mounting, and thus the terminals are efficiently surface-mounted on a wiring board in a target portable transceiver with high mounting position accuracy.

Figure 3:
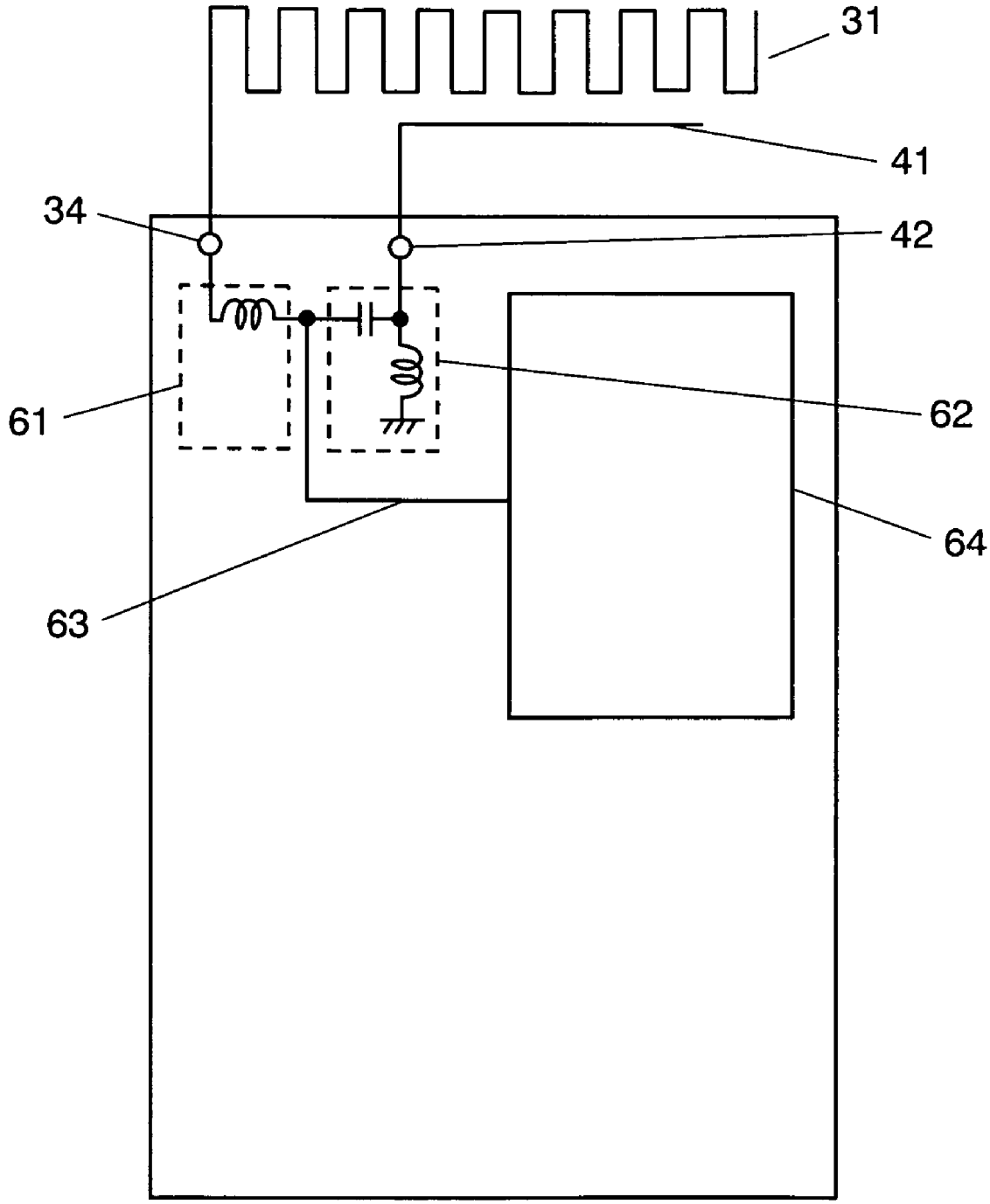
FIG. 3 is a schematic view illustrating installation of the antenna.

In the antenna for portable cellular telephone, terminals 34 and 42, which are feeding points, are provided to first antenna element 31 and second antenna element 41 respectively. Accordingly, as shown in FIG. 3, terminal 34 can be coupled to first matching circuit 61 configured in the target mobile terminal when first antenna element 31 is installed. Terminal 42 of second antenna element 41 can also be coupled to second matching circuit 62, which is different from first matching circuit 61, configured in the target mobile terminal. First matching circuit 61 and second matching circuit 62 are coupled to one radio circuit 64 in the mobile terminal via transmission line 63.

The above way of installation allows the antenna for portable cellular telephone to finely adjust first antenna element 31 and second antenna element 41 to a predetermined radio frequency separately using first matching circuit 61 or second matching circuit 62.

Next, other features of the antenna for mobile radio terminal of an exemplary embodiment of the present invention are described. The length of first antenna element 31 is longer than second antenna element 41, and resonates at 880~960 MHz which is the GSM radio frequency. Second antenna element 41 is set to resonate at DCS (1710~1880 MHz)/PCS (1850~1990 MHz)/UMTS (1920~2170 MHz) frequencies, which are higher than those for first antenna element 31.

Utilization of capacitive coupling of first antenna element 31 and second antenna element 41 is described next.

In the antenna as configured above, first antenna element 31 for low radio frequency and second antenna element 41 for high radio frequency are anchored to common base 21, but first antenna element 31 and second antenna element 41 have individual terminals 34 and 42, respectively, as feeding points.

When first antenna element 31 and second antenna element 41 are disposed on small base 21, capacitive coupling occurs between these antenna elements in the antenna for portable cellular telephone.

By using a so-called capacitive-coupling antenna, is improvement of characteristics in applicable radio frequency bands by utilizing capacitive coupling. This mechanism is described next with reference to FIGS. 4A, 4B, 5A, 5B, 6A and 6B.

First, the state when only first antenna element 31 is operated is described. More specifically, the power is fed only to first antenna element 31 and not to second antenna element 41.

Figure 4A:
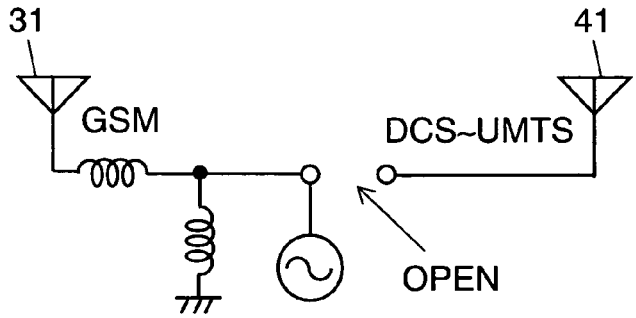
FIG. 4A is a matching circuit diagram when only a first antenna element is operated.
Figure 4B:
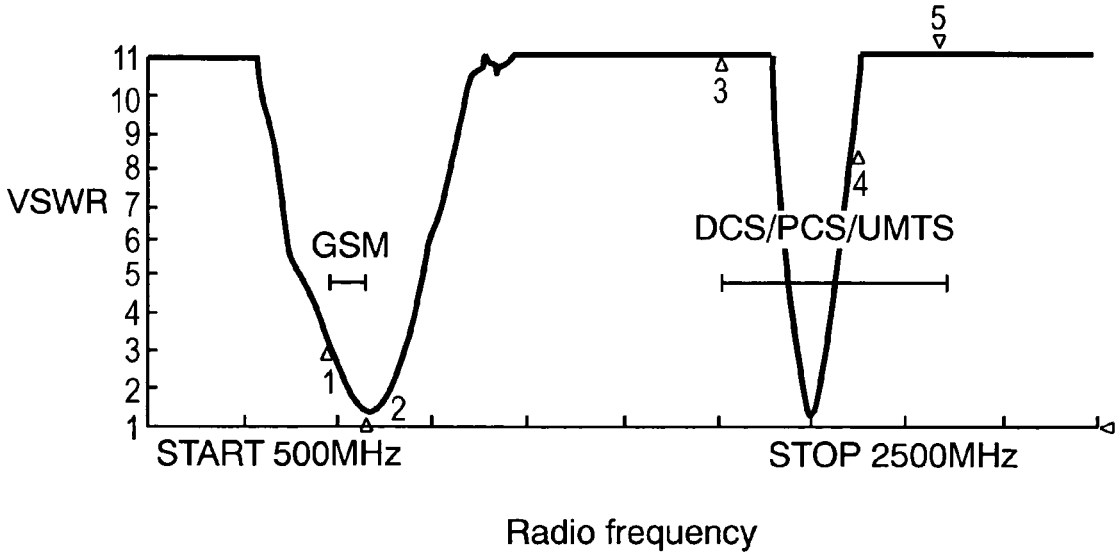
FIG. 4B is a VSWR (Voltage Standing Wave Ratio) chart when only the first antenna element is operated.

In the drawings mentioned above, FIG. 4A is a matching circuit diagram when only first antenna element 31, which resonates at the GSM radio frequency band of 880~960 MHz, is operated. FIG. 4B is a VSWR chart in this state. The lateral axis in FIG. 4B, and FIGS. 5B and 6B which will be described later, indicates the radio frequency. The minimum (left end) is 500 MHz and the maximum (right end) is 2500 MHz. Each scale mark on the lateral axis is equivalent to 200 MHz. In other words, the radio frequency increases to 500 MHz, 700 MHz, 900 MHz . . . 2100 MHz, 2300 MHz, and 2500 MHz from the left to right end.

As shown in FIG. 4B, first antenna element 31 also has a resonance point at a high frequency. This resonance point is set within or near the resonance frequency band of second antenna element 41.

The harmonic of three times of the GSM radio frequency band appears in resonance with the high radio frequency. Here, capacitive coupling can be increased by placing first antenna element 31 and second antenna element 41 in closer proximity, or by making base 21 of a high-dielectric material. Consequently, the resonance frequency can be reduced to the desired DCS/PCS/UMTS radio frequency bands.

Accordingly, two resonance points that resonate in GSM band and one in the DCS/PCS/UMTS radio frequency bands can be created by controlling the distance between first antenna element 31 and second antenna element 41 or controlling dielectric constant of base 21.

Next, the state when only second antenna element 41 is operated is described. More specifically, the power is fed only to second antenna element 41, and not to first antenna element 31.

Figure 5A:
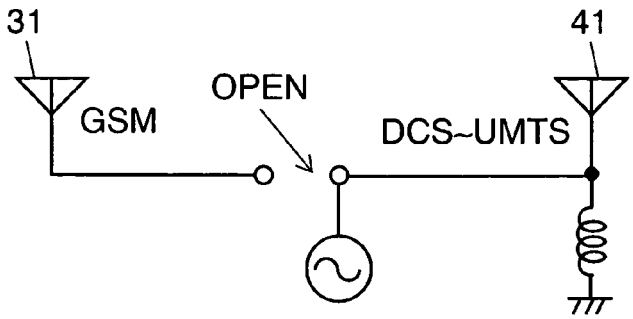
FIG. 5A is a matching circuit diagram when only a second antenna element is operated.

FIG. 5A is a matching circuit diagram when only second antenna element 41, which is set to resonate at DCS (1,710~1,880 MHz)/PCS (1,850~1,990 MHz)/UMTS (1,920~2,170 MHz) radio frequencies, is operated.

Figure 5B:
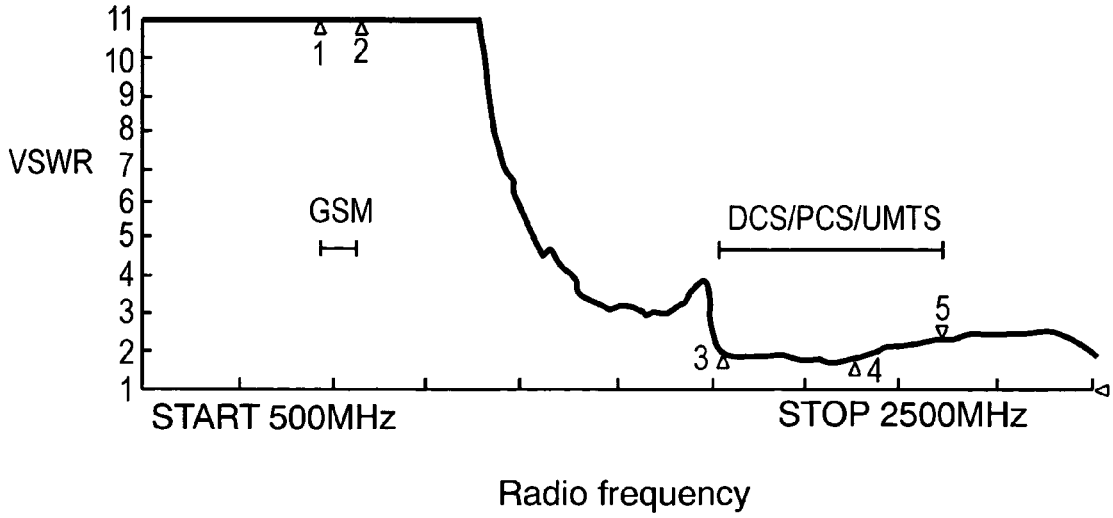
FIG. 5B is a VSWR chart when only the second antenna element is operated.

FIG. 5B is a VSWR chart in the above state. As shown in FIG. 5B, second antenna element 41 resonates at a radio frequency corresponding to the frequency band of DCS/PCS/UMTS.

Lastly, the state when both antennas are operated is described. In other words, power is fed to both first antenna element 31 and second antenna element 41.

Figure 6A:
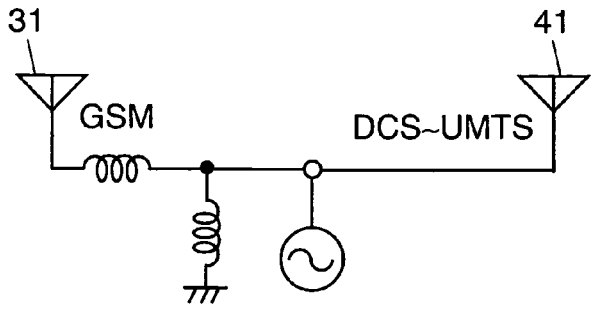
FIG. 6A is a matching circuit diagram when capacitive coupling is established between the first and second antenna elements in operation.
Figure 6B:
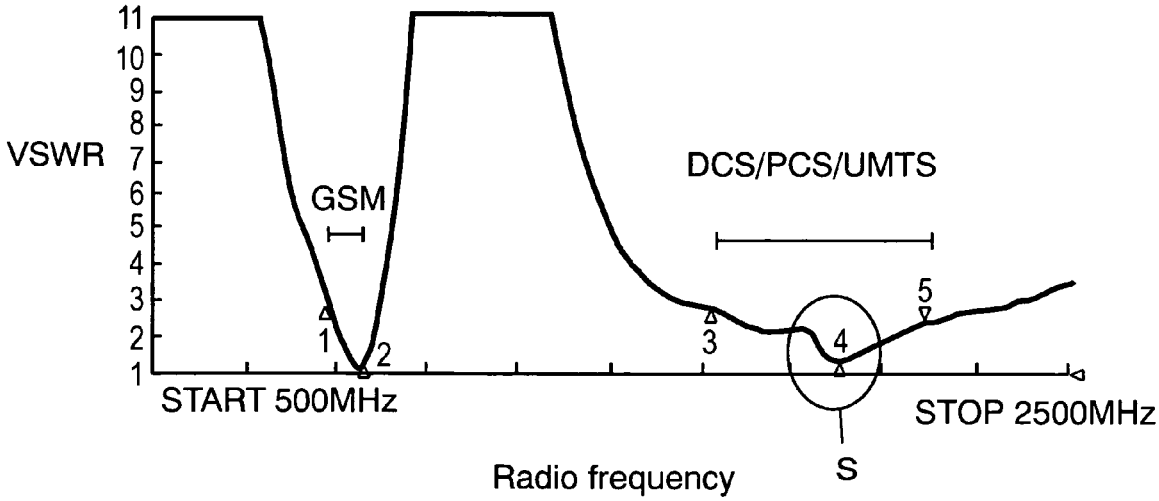
FIG. 6B is a VSWR chart when capacitive coupling is established between the first and second antenna elements in operation.

FIG. 6A is a matching circuit diagram in which first antenna element 31 and second antenna element 41, which are set to resonate at GSM/DCS/PCS/UMTS, are operated. FIG. 6B is a VSWR chart in this state.

Here, resonance at a high radio frequency when only first antenna element 31 is operated, as shown in FIG. 4B, and resonance when only second antenna element 41 is operated, as shown in FIG. 5B, overlap. Consequently, as shown by area S in FIG. 6B, a broad radio frequency band in DCS (1710~1880 MHz)/PCS (1850~1990 MHz)/UMTS (1920~2170 MHz) is achievable.

With respect to the volume of base 21 installable inside the portable transceiver, the resonance frequency of first antenna element 31 at higher radio frequencies is generated at a slightly lower frequency than that of second antenna element 41. Accordingly, a broader band for high radio frequencies is also achievable through capacitive coupling described above by setting the frequency of second antenna element 41 slightly higher.

First antenna element 31 and second antenna element 41 can be coupled to separate matching circuits 61 and 62 through separate feeding points. Accordingly, first antenna element 31 and second antenna element 41 can be easily and finely adjusted to target radio frequencies, facilitating achievement of the above characteristic.

The above exemplary embodiment describes the case of anchoring two antenna elements, i.e., first antenna element 31 and second antenna element 41, to base 21. It is apparent that three or more antenna elements with a separate feeding point can be anchored to one common base.

In case of the antenna for portable cellular telephone that has terminals 34, 42 and 51 suitable for surface mounting as described above, stretching and shrinking occurs in a longer side of base 21 during mounting if base 21 is an approximate rectangular parallelepiped. In particular, a twisting force is likely to be applied to the soldered portion of dummy terminal 51 protruding from the longer side face.

Figure 7:
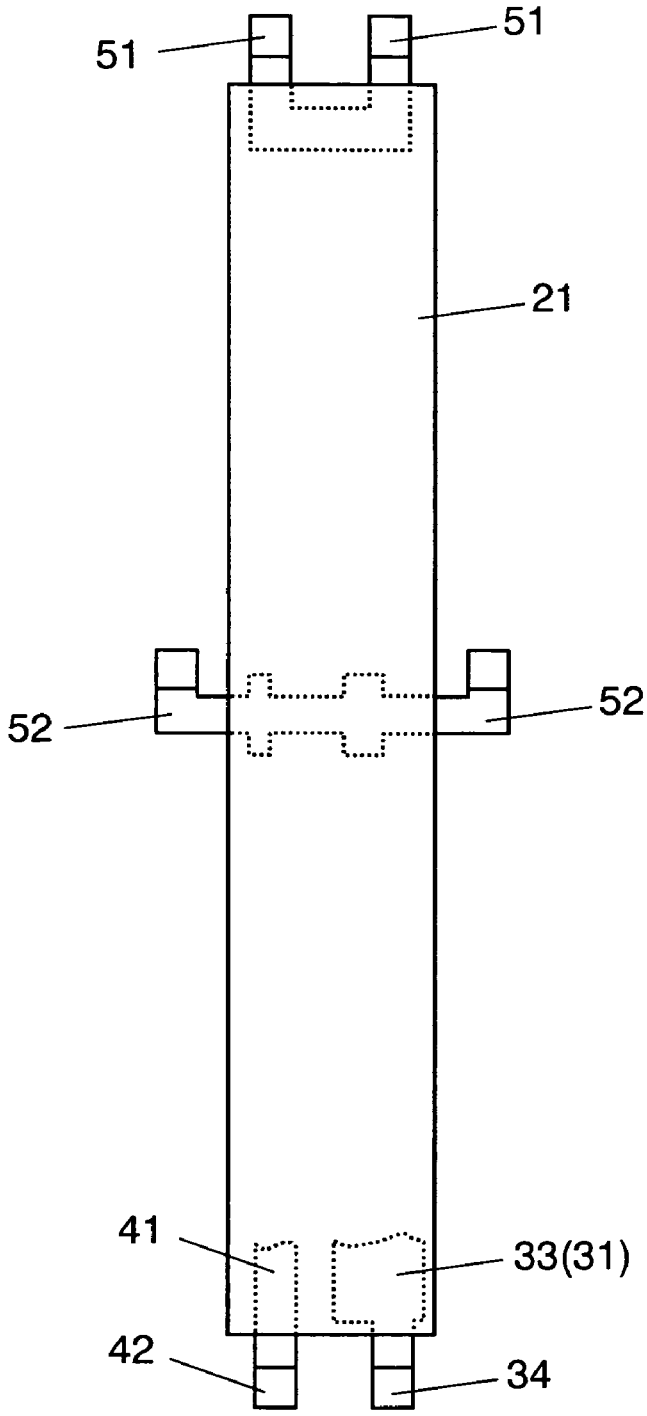
FIG. 7 is a bottom view of an example of a modified antenna terminal.

An improvement measure is shown in FIG. 7. Dummy terminal 52 disposed on the longer side face of base 21 is formed into an L-shape when seen from the top. More specifically, dummy terminal 51 protrudes perpendicularly from the side face and is then bent parallel to the side face. This tip parallel to the side face is soldered. This structure reduces the protrusion distance from the side face, and the L-shape portion reduces the impact of stretching and shrinking of base 21 in the longer-side direction. Even when base 21 stretches or shrinks in line with the use environment of the portable transceiver, an impact can also be reduced by this L-shape portion. Stable mounting conditions can thus be retained for a long period.

As described above, an antenna for portable cellular telephone has terminals 34 and 42, i.e., separate feeding points, for first antenna element 31 and second antenna element 41. This allows further downsizing and thinning of the external design.

Figure 8:
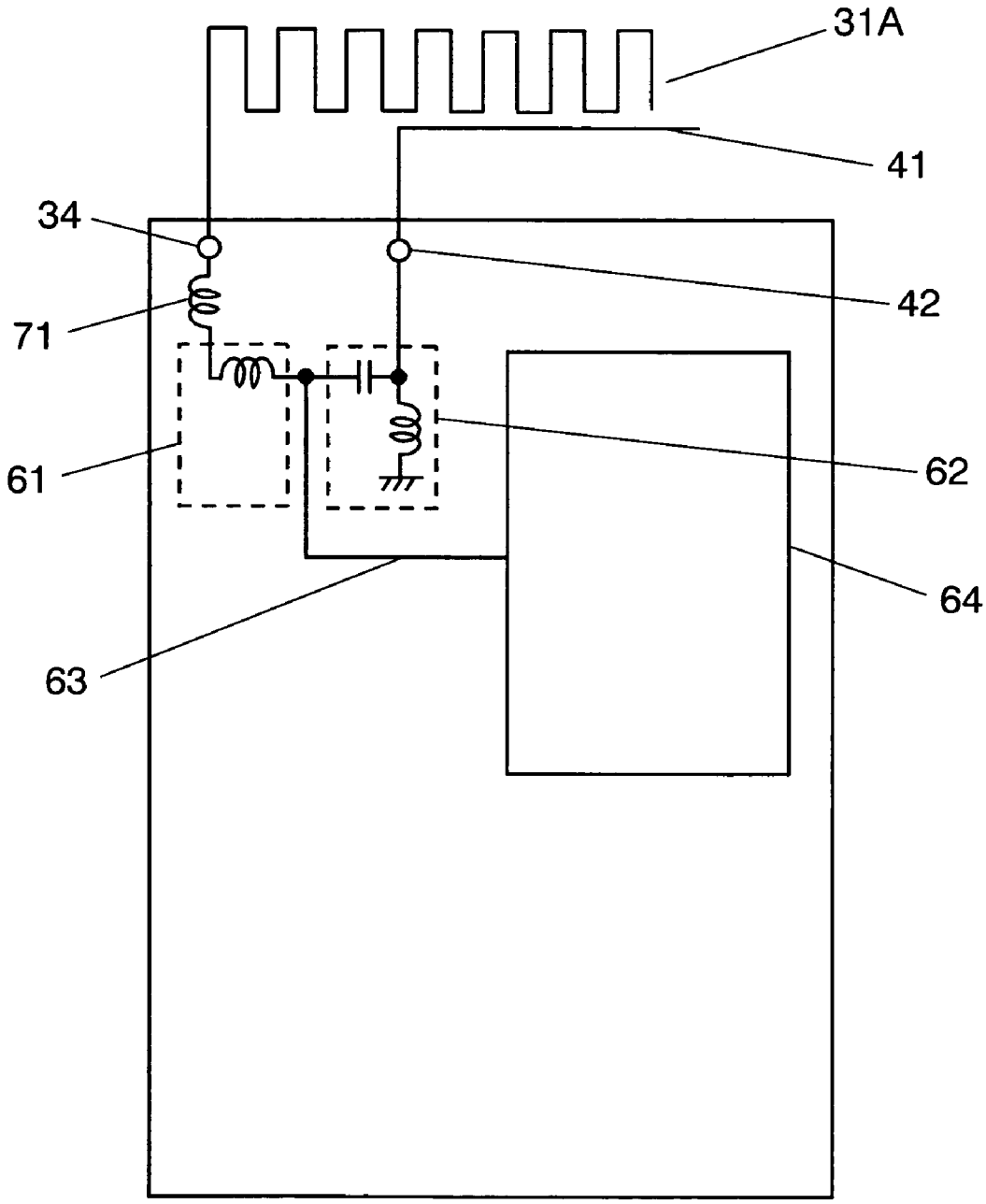
FIG. 8 is a schematic view illustrating another installation of the antenna.
Figure 9:
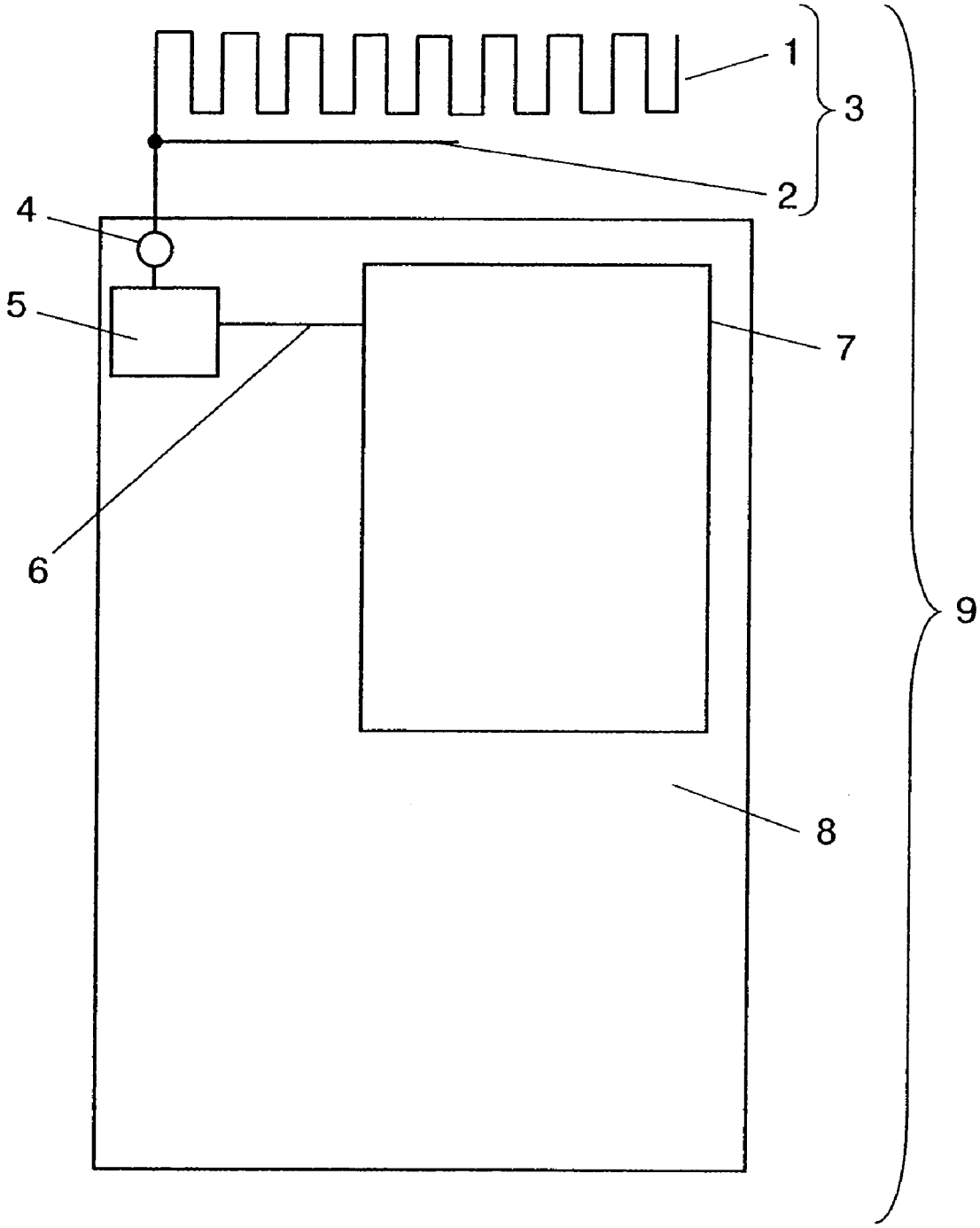
FIG. 9 PRIOR ART
FIG. 9 is a schematic view of a mobile phone to which a conventional antenna for portable cellular telephone is installed.

In other words, the size of base 21 in the antenna for portable cellular telephone needs in particular to have a predetermined shape sufficient for a predetermined antenna length required for first antenna element 31 for use with low radio frequencies. However, as shown in FIG. 8, first antenna element 31A is set, for example, to an antenna length shorter than that required for GSM (889~960 MHz). In this case, chip coil 71 is mounted in series between the feeding point of first antenna element 31A and first matching circuit 61 to compensate for the coil length difference.

The antenna for mobile radio terminals is configured to provide separate feeding points for first antenna element 31A and second antenna element 41. Accordingly, the influence on the other antenna element 41 is minimal, even if a chip coil is provided. In addition, a section of first antenna element 31A can be adjusted using a separate matching circuit 61 coupled to first antenna element 31A, as described above.

The above structure allows downsizing of first antenna element 31A which requires a long antenna length, and in turn the antenna for portable cellular telephone can be made smaller and thinner. If the antenna length of the first antenna element 31A becomes too short, antenna radiation efficiency degrades, so chip coil 71 is preferably set to about 110 nH, for example, for first antenna element 31A corresponding to the above GSM (880~960 MHz), and the antenna length of first antenna element 31A is preferably shortened by about ¼ to 1/10.

The technical idea of the present invention is applicable not only to first antenna element 31A but also to second antenna element 41. In addition, chip coil 71 can be replaced typically by a coil member disposed inside the matching circuit without the need for a separate coil.

INDUSTRIAL APPLICABILITY

The antenna for portable cellular telephone includes terminals, designed suitable for surface mounting, that act as feeding points for each separate antenna element anchored to one common base. Each antenna element can thus be coupled to a separate matching circuit for efficiently adjusting each antenna element to the required radio frequencies.

What is claimed is:

1. An antenna for portable cellular telephone comprising:

a first antenna element having a first feeder coupled to a first matching circuit, the first feeder provided between the first antenna element and the first matching circuit; and a second antenna element having a second feeder coupled to a second matching circuit, the second feeder provided between the second antenna element and the second matching circuit;

wherein the first antenna element and the second antenna element are anchored to one common resin base.

2. The antenna according to claim 1, wherein a capacitive coupling is established between the first antenna element and the second antenna element via the resin base, and the capacitive coupling improves a sensitivity at a high radio frequency band.

3. The antenna according to claim 1, wherein the first feeder and second feeder are each terminals suitable for surface mounting.

4. The antenna according to claim 3, wherein the base is approximately rectangular parallelepiped, and one of a feeding terminal and a dummy terminal is disposed on a longer side face of the base and has an L-shape, the terminal protruding sideward from the base and a surface-mounting portion of the terminal being parallel to the longer side of the base.

5. The antenna according to claim 1, wherein one of the first antenna element and the second antenna element has an antenna length shorter than a length equivalent to a radio frequency in an operating area to form an insufficient coil component, and the insufficient coil component is compensated for by a coil element installed in a portable transceiver.

* * * * *